US005226647A

United States Patent [19]

Notarmuzi

[11] Patent Number: 5,226,647

[45] Date of Patent: Jul. 13, 1993

[54] MULTI-PURPOSE GOLFER'S ACCESSORY

[76] Inventor: Gerard E. Notarmuzi, 12257 W. New Mexico Pl., Lakewood, Colo. 80228

[21] Appl. No.: 875,255

[22] Filed: Apr. 27, 1992

[51] Int. Cl.[5] ..... A63B 57/00

[52] U.S. Cl. ..... 273/32 B; 273/32 D; 224/918; 172/380; 172/713; 15/236.08; 30/169

[58] Field of Search ..... 224/918, 919, 274; 273/32 R, 32 B, 32 D, 32 A, 32 H; 33/563, 564, 565, 566; 172/713, 380; 15/236.08; 30/169

[56] References Cited

U.S. PATENT DOCUMENTS

| | | | |
|---|---|---|---|
| D. 137,340 | 2/1944 | Lozier | 33/565 X |
| D. 165,253 | 11/1951 | Ward | 224/918 |
| 2,112,339 | 3/1938 | Kasparek | 224/918 X |
| 2,784,497 | 3/1957 | Blondin | 33/566 |
| 3,203,700 | 8/1965 | Antonious | 273/32 B X |
| 3,540,727 | 11/1970 | Hoe | 224/918 X |
| 3,870,300 | 3/1975 | Amendola | 273/32 B |
| 4,063,731 | 12/1977 | Kitay | 273/32 B |
| 4,226,350 | 10/1980 | Detje | 224/919 X |
| 4,475,676 | 10/1984 | Smith | 224/918 |
| 4,838,285 | 6/1989 | Petrone | 273/32 B X |
| 5,007,129 | 4/1991 | Hainey | 273/32 B X |
| 5,076,581 | 12/1991 | Boberg | 273/32 R |
| 5,116,046 | 5/1992 | Pace | 273/32 B |
| 5,121,519 | 6/1992 | Haugom | 273/32 A X |

*Primary Examiner*—George J. Marlo

*Attorney, Agent, or Firm*—Edwin H. Crabtree; Donald W. Margolis

[57] ABSTRACT

There is disclosed a multi-purpose golfer's accessory with a straight edge (10) defining a scraper, a formation of prongs (12) defining a green repair mechanism, the base of a club stand, the base of a cigarette holder, and a spike cleaning device, a cutout (14) defining a tee carrier, a notch (18) defining a cigarette holder, a tooth (20) defining a club face groove cleaner, a cusp (16) defining a bottle opener in conjunction with tooth (20), a set of two tabs (22) defining a spike wrench, a lead-in neck (24) and a cutout (26) defining a club grip stand when used in conjunction with prongs (12), a ball marker holder formed as a hole (28), and a hole (30) defining an attachment point for a key chain, hook, or other attachment device.

13 Claims, 1 Drawing Sheet

MULTI-PURPOSE GOLFER'S ACCESSORY

BACKGROUND—FIELD OF INVENTION

This invention relates to golf accessories; more particularly to golfer's accessories which coordinate several functions in a single apparatus.

BACKGROUND—CROSS-REFERENCE TO RELATED APPLICATIONS

Previously I have filed an invention disclosure under the Patent and Trademark Office "Disclosure Document Program".

Date: Dec. 2, 1991

Identifying No.: 297157

BACKGROUND—DESCRIPTION OF PRIOR ART

The game of golf encompasses a variety of activities, both during the preparation and playing of the game, and also during the maintenance of golf equipment. Commonly, the handling of several articles and pieces of hardware is necessary. These activities include tightening, loosening, removing, and replacing the spikes on golf shoes, green repair, cleaning around the spikes on golf shoes, cleaning the grooves on the faces of golf clubs, cleaning dirt and debris from clubs, shoes, golf cart wheels, etc., carrying a golf tee and a ball marker, possibly smoking or drinking before, after, or during the game, and other activities as will become apparent in the ensuing description. In the past, inventors have described a variety of multi-purpose golf accessories. However, heretofore, the combination accessories have had one or more disadvantages.

(a) Their shape makes them awkward to use.

(b) Their size makes them awkward to handle.

(c) Their design includes movable parts, rendering the tool more prone to malfunction or breakage.

(d) They provide only a minimal number of functions, necessitating the need for more than one accessory.

(e) They do not eliminate the need to separately carry a tee or a ball marker.

(f) They are inconvenient to carry.

(g) They are uncomfortable to carry in a pocket.

(h) They are prohibitively expensive or difficult to produce.

(i) They require a multi-piece construction to secure a golf tee or a ball marker.

(j) They are prohibitive of substituting several other construction materials.

(k) They do not provide a mechanism to securely retain a golf club grip in a grip stand to prevent the club from being knocked onto the ground.

(l) They do not combine multiple tool functions and carrying capabilities in a simple, one-piece apparatus.

OBJECTS AND ADVANTAGES

Accordingly, several objects and advantages of my invention are:

(a) To provide an accessory that is shaped for easy manipulation;

(b) to provide an accessory which is sized for easy handling;

(c) to provide an accessory which comprises a one-piece durable construction;

(d) to provide an accessory which reduces the need to handle several articles during the preparation and the playing of golf, and during the maintenance of golf equipment;

(e) to provide an accessory which eliminates the need for a separate carrier for either a golf tee or a ball marker;

(f) to provide an accessory which is convenient to carry in a golf bag or any other place;

(g) to provide an accessory which is comfortable to carry in a pocket;

(h) to provide an accessory that is easy and economical to produce;

(i) to provide an accessory with a one piece construction capable of securing a golf tee and a ball marker;

(j) to provide an accessory which allows easy substitution of a variety of construction materials;

(k) to provide an accessory which securely retains a golf club grip when used as a club grip stand; and (l) to provide an accessory which combines multiple tool functions and carrying capabilities in a simple, one-piece apparatus.

Further features of the invention pertain to the particular arrangement of the parts of the accessory whereby the above-outlined features thereof are attained. The invention, both as to its organization and method of operation together with further objects and advantages thereby will become apparent from a consideration of the drawings and the ensuing description of it.

DRAWING FIGURES

REFERENCE NUMERALS IN DRAWING

10: STRAIGHT EDGE
12: PRONGS
14: CUTOUT
16: CUSP
18: NOTCH
20: TOOTH
22: TABS
24: LEAD-IN NECK
26: CIRCULAR CUTOUT
28: HOLE
30: HOLE
32: HOLE
34: GOLF TEE
36: BALL MARKER.

DESCRIPTION

FIGS. 1–4

Figure 1:
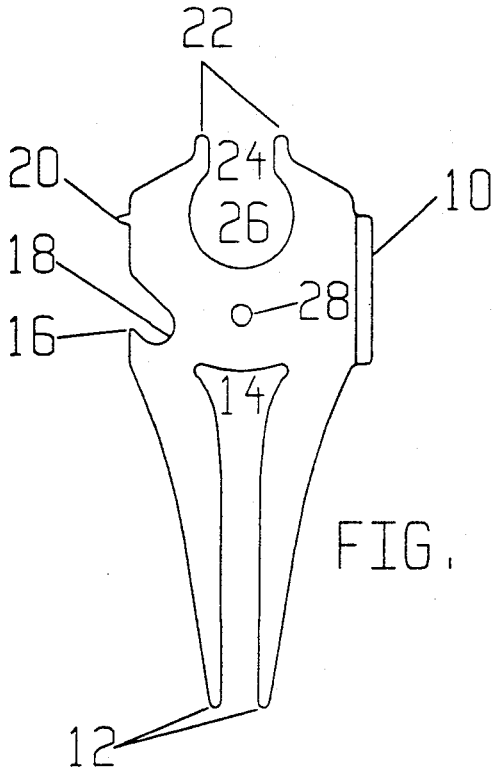
FIG. 1 is a front plan view of one lateral surface of the golfer's accessory constructed in accordance with and embodying the features of the present invention.

A typical embodiment of the golfer's accessory of the present invention is illustrated in FIG. 1. The tool consists of a rigid or semi-rigid sheet of material which can withstand repeated and varied manipulations without fracturing. In the preferred embodiment the golfer's accessory is constructed of a sheet of 304 type stainless steel, 14 gauge thick. However, the accessory can be constructed of any other material which can be manipulated without fracturing, such as other types of metals, brass, hard plastics, or any other suitable material. The accessory can be laser cut or manufactured by metal stamping, fine-blanking, or grip-flow.

Figure 2:
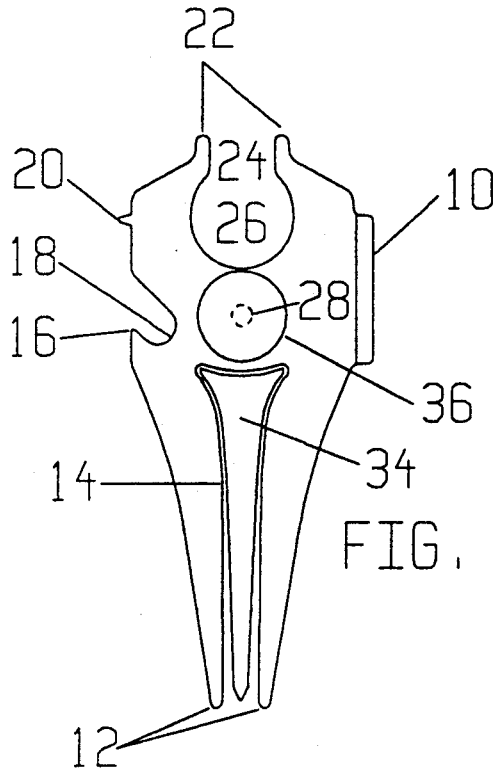
FIG. 2 is a front plan view of the golfer's accessory of the present invention showing a golf tee and a ball marker being carried.

At one side of the accessory is a straight edge 10 which has been beveled to a 45 degree angle to assist in scraping. The bottom of the accessory is formed into a pair of prongs 12. The length of prongs 12 approximately equals the length of a golf tee 34 (FIG. 2). Between prongs 12 is a cutout 14 which resembles a silhouette of the upper portion a golf tee. On the opposite side of the accessory from edge 10, is a cusp 16. Cusp 16 forms one side of an opening into a notch 18. On the same side as cusp 16 and notch 18 is a tooth 20. The top of the accessory opposite prongs 12, is formed into a set of two tabs 22. Between tabs 22 is a lead-in neck 24 leading to a circular cutout 26. In the interior of the accessory is a hole 28 which is chamfered on both the front and back surfaces of the construction material. FIG. 2 shows cutout 14 holding golf tee 34 and hole 28 holding a ball marker 36.

Figure 3:
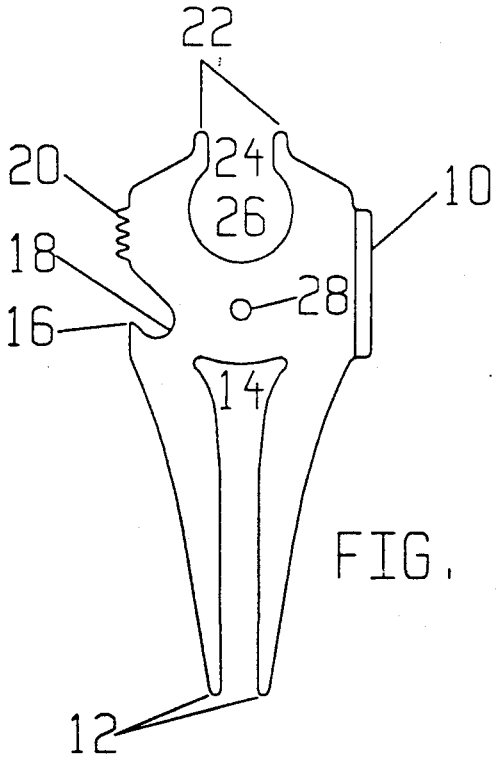
FIG. 3 is a front plan view of a similar tool with multiple teeth.
Figure 4:
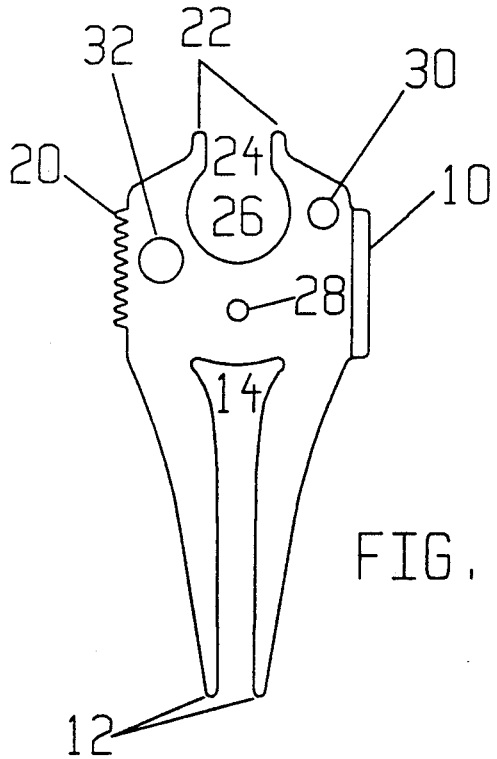
FIG. 4 is a front plan view of a golfer's accessory constructed with alternate features showing multiple teeth, and the addition of two holes.

Additional embodiments are shown in FIGS. 3 and 4. FIG. 3 shows tooth 20 partially multiplied along the side of the accessory. FIG. 4 shows tooth 20 multiplied along the side of the accessory, the elimination of cusp 16 and notch 18, the addition of a hole 30 for the attachment of a key chain, hook, or other attachment device, and the addition of a hole 32 to hold a cigarette.

From the description above, a number of advantages of my one-piece multi-purpose golfer's accessory become evident.

(a) The shape allows for easy use of each feature.

(b) The size of the accessory permits it to be easily handled.

(c) The one piece design is durable.

(d) The multi-function design reduces the need to handle several articles and pieces of hardware to prepare and to play golf, and to maintain golf equipment.

(e) The accessory eliminates the need for a separate golf tee or ball marker carrier.

(f) The accessory is convenient to carry in a golf bag or any other place.

(g) The accessory is comfortable to carry in a pocket.

(h) The accessory is easy and economical to produce.

(i) The accessory secures a golf tee and a ball marker using a one-piece construction.

(j) The accessory allows for easy substitution of a variety of construction materials.

(k) The accessory securely holds the grip of a golf club off of the ground.

(l) The accessory combines multiple tool functions and carrying capabilities in a simple, one-piece apparatus.

OPERATION—FIGS. 1-4

Referring now to FIGS. 1-4, the multi-purpose golfer's accessory provides a scraper of dirt and debris when edge 10 is held perpendicular, or at any other suitable angle as necessary, to the item to be cleaned. This may include a club face, a golf cart wheel, shoes, etc. Edge 10 is moved back and forth in a motion appropriate to scrape dirt and debris away from the object to be cleaned.

The accessory provides a green repair tool when prongs 12 are used. Prongs 12 are placed into and under an impression mark on a green and the affected area is gently lifted back into place. This restores the smoothness of the green, as it was prior to the impression being made.

The accessory further provides a spike cleaner when prongs 12 are placed around a spike on a golf shoe and turned, moved in a scraping motion, or otherwise manipulated to remove dirt and debris from around the spikes on golf shoes.

Furthermore, the accessory provides a tee carrier when cutout 14 is utilized. Cutout 14 is designed with a specific tolerance which allows it to grip the top and sides of golf tee 34. In the preferred embodiment golf tee 34 is FLEX-TEE TM brand golf tee. FLEX-TEE is a trademark of Patrick and Janis Liccardello of Albuquerque, N. Mex. However, the accessory can be adapted to any brand of golf tee. Golf tee 34 is held in place until needed, at which time it is easily pressed out from its place in cutout 14. When storage of golf tee 34 is desired, it is easily pressed back into place in cutout 14 which frictionally retains golf tee 34 firmly in position, as seen in FIG. 2.

Referring now to FIGS. 1-3 only, the accessory functions as a cigarette holder when prongs 12 are pushed into the ground, which renders notch 18 off of the ground. In turn this allows a cigarette to be placed in notch 18, which will keep the cigarette off of the ground. This is useful to keep the cigarette from getting dirty, wet, contaminated with lawn care chemicals, or any other undesirable matter. Frequently golfers place a lighted cigarette on the ground while making a shot, and then pick it up to resume smoking after the shot is completed. FIG. 4 shows hole 32 which can also be used to hold a cigarette.

The accessory further provides a bottle opener when cusp 16 and tooth 20 (FIGS. 1-3) are used simultaneously. Cusp 16 is placed under a groove on the side of a bottle cap and the accessory is maneuvered until tooth 20 is pointed down into the top of the bottle cap. When upward pressure is applied on prongs 12 of the accessory, tooth 20 presses firmly into the top of the bottle cap giving cusp 16 leverage the pry the cap up and off of the bottle.

A groove cleaner for irons is further provided, when the accessory is held by hand with tooth 20, seen in FIGS. 1 and 2, held perpendicular to a specific groove on the club head face of an iron. Tooth 20 is inserted into the specific groove in need of removal of dirt or other debris. The accessory is then moved back and forth longitudinally along the groove. This movement scrapes the dirt or other debris from the groove on the iron. Subsequently, upon the completion of cleaning the groove, the accessory is removed from the groove, and tooth 20 is then similarly placed into another groove, and used to clean that groove, until all of the grooves in need of cleaning are cleaned. FIG. 3 shows tooth 20 multiplied along the same side as the single tooth 20, whereby several grooves on the face of an iron can be cleaned simultaneously. Tooth 20 can be spaced accordingly to fit any brand of golf club irons. FIG. 4 shows the accessory without cusp 16 or notch 18, and with tooth 20 multiplied even further along the side.

Referring now to FIGS. 1-4, the accessory also provides a spike wrench when tabs 22 are employed. Lead-in neck 24 accommodates a spike on a golf shoe. The accessory is held perpendicular to the flat surface of the spike and tabs 22 are inserted into the holes on the spike. The accessory is then turned to create leverage to twist the spike in a desired and necessary direction to tighten, loosen, remove, or replace the spike.

The accessory further provides a club grip stand when a golf club shaft and grip accommodating cutout, consisting of lead-in neck 24 and circular cutout 26, is used. The lower end of a club shaft is slipped through lead-in neck 24 and into circular cutout 26 which is thereby positioned around the shaft of the club in need of support off of the ground. After the club shaft has been slipped into circular cutout 26, the accessory is then moved upward, toward the grip of the club as far as possible with the shaft or grip in circular cutout 26. As soon as circular cutout 26 is snug around the shaft or grip, prongs 12 are pushed into the ground. The placement of prongs 12 in the ground renders circular cutout 26 off of the ground which in turn renders the grip of the club off of the ground. Often the grass on a golf course is wet and it is desirable to keep a club grip dry. Also, if a club is laid flat on the ground it is not as visible to the golfer and therefore may be left behind. The club grip stand keeps the club raised and visible so it is not forgotten. The arrangement of lead-in neck 24 in combination with circular cutout 26 renders the club grip secure. The club cannot be blown or accidentally knocked from its position in circular cutout 26. When a grip stand is no longer needed, the accessory is pulled from the ground and slid down the grip and shaft of the golf club until the club shaft can easily be slipped out of lead-in neck 24, and thereby removed.

The accessory also provides a ball marker carrier when hole 28 is used. The stem of ball marker 36 is pressed into hole 28, being thereby frictionally retained by hole 28 due to a specific tolerance of hole 28 in relation to the diameter of the stem of ball marker 36. FIG. 2 shows a ball marker being carried. In the preferred embodiment of the invention, ball marker 36 is part of FLEX-TEE TM brand golf tee. However, the ball marker carrier can be adapted to any brand of ball marker having a stem.

Additionally, the accessory provides hole 30 as an attachment place for a key chain, hook or other attachment device, as seen in FIG. 4.

Accordingly, the reader will see that the multi-purpose accessory of this invention can be used and handled easily and conveniently to perform many of the activities associated with the preparation and playing of a game of golf, and the maintenance of golf equipment. Also, it can be carried comfortably and conveniently in a pocket or other place. Furthermore, it reduces the need to handle several pieces of hardware, by combining tool functions and carrying capabilities. This accessory also eliminates the need for a separate carrier for either a golf tee or a ball marker. It eliminates the need for a multi-piece construction to hold a golf tee or a ball marker. It supports a club grip in a secure manner. In addition, the one-piece construction has the additional advantages in that:

it is easy and economical to produce it is durable and not prone to breakage or malfunction it allows easy substitution of other suitable construction materials Although the description above contains many specificities, these should not be construed as limiting the scope of the invention, but as merely providing illustrations of some of the presently preferred embodiments of this invention. For example, the accessory can be made of other materials such as brass, hard plastics, plated metals, etc. It can be plated or painted. The holes and cutouts can be shapes other than circular. Also, the accessory can be made of magnetic reactive material which permits it to be secured to a piece of magnetic material in a golf bag or other place until needed, at which time it can easily be detached. It can be made of magnetic material to allow it to be secured to a magnetic reactive piece of material on a golf bag or other place. Furthermore, a clip can be welded or otherwise attached to the back of the tool to permit carrying on a belt or other place. The ball marker carrier can be constructed with a snap receiving apparatus to receive a ball marker having a complementary snap as the stem of the ball marker. Furthermore, the parts are arranged to allow sufficient room to engrave or otherwise place advertising or emblems on the accessory.

Thus the scope of this invention should be determined by the appended claims and their legal equivalents, rather than by the examples given.

I claim:

1. A golfer's accessory for repairing turf and holding a golf tee, the golf tee having a concave top portion used for receiving part of a golf ball thereon and a pointed bottom portion used for inserting into a ground surface, the accessory comprising:

a flat sheet material, said flat sheet material having an upper portion, a bottom portion, a first side portion and a second side portion;

a golf tee carrier cutout in the bottom portion of said sheet material, said cutout having a top convex portion and oppositely disposed side portions flared inwardly toward each other and downwardly, and of sufficient dimensions to accommodate the length of the golf tee longitudinally, the golf tee when received in said cutout on said sheet material extending downwardly from said convex portion to an opening in the bottom portion of said sheet material, said cutout having a shape of a silhouette of the golf tee, said cutout dimensioned for receiving the golf tee longitudinally in a frictional press fit, and opposite sides of the bottom portion of said sheet material being tapered inwardly and downwardly with said cutout in said sheet material disposed between said downwardly tapered sides of the bottom portion of said sheet material, said tapered sides with said cutout disposed therebetween forming a pair of prongs, said prongs used for a golf green repair tool.

2. The accessory as described in claim 1 wherein said sheet material is made of metal or hard plastic.

3. The accessory as described in claim 1 wherein the top portion of said sheet material includes a lead-in neck opening connected to a circular cutout in said sheet material, a width of the lead-in neck opening less than the diameter of the circular cutout, the lead-in neck opening adapted for receiving a portion of the golf shaft therethrough, the circular cutout adapted for receiving a portion of the golf grip when the golf shaft is received therein and the golf grip is moved into an engaged position with sides of the circular cutout.

4. The accessory as described in claim 3 wherein the top portion of said sheet material includes a pair of tabs disposed on opposite sides of said lead-in neck opening and extending upwardly therefrom, said tabs used for inserting into the pair of holes on the golf shoe spike for tightening or loosening the spike, a portion of the spike received through the lead-in opening.

5. The accessory as described in claim 1 wherein the first side portion of said sheet material includes a straight edge, said straight edge used as a scraper for cleaning golf related items.

6. The accessory as described in claim 1 wherein the second side portion of said sheet material includes an outwardly extending tooth, said tooth used for cleaning golf related items such as the face of a golf club.

7. The accessory as described in claim 6 wherein the second side portion of said sheet material includes a plurality of outwardly extending teeth, said teeth used for cleaning golf related items such as the face of a golf club.

8. The accessory as described in claim 1 wherein the second side portion of said sheet material includes a notch therein with a cusp formed adjacent one side of said notch.

9. The accessory as described in claim 8 wherein said notch and said adjacent cusp are used as a bottle opener.

10. The accessory as described in claim 8 wherein said notch is used as a cigarette holder with said prongs used for holding the cigarette above the ground surface.

11. The accessory as described in claim 1 wherein said sheet material includes a hole therein, said hole used for receiving a portion of a golf ball marker therein in a frictional press fit.

12. The accessory as described in claim 1 wherein said sheet material includes a hole therein, said hole used for receiving a portion of a key chain therethrough.

13. The accessory as described in claim 1 wherein said sheet material includes a hole therein, said hole used for receiving a portion of a cigarette therethrough, said prongs used for holding the cigarette above the ground surface.

* * * * *